US005140165A

United States Patent [19]

Kiuchi et al.

[11] Patent Number: 5,140,165

[45] Date of Patent: Aug. 18, 1992

[54] VESSEL FOR SOLIDIFICATION TREATMENT OF RADIOACTIVE WASTE PELLETS

[75] Inventors: Yoshimasa Kiuchi, Katsuta; Takahiro Sanada, Hitachi; Hiroyuki Tsuchiya, Hitachi; Shoichi Ouchi, Hitachi, all of Japan

[73] Assignees: Hitachi, Ltd.; Hitachi Engineering Co., Ltd.; Hitachi Nuclear Engineering Co., Ltd.; Hitachi Engineering and Services Co., Ltd., all of Ibaraki, Japan

[21] Appl. No.: 708,228

[22] Filed: May 31, 1991

[30] Foreign Application Priority Data

May 31, 1990 [JP] Japan ..... 2-141890

[51] Int. Cl.[5] ..... G21F 5/00

[52] U.S. Cl. ..... 250/506.1; 252/633; 220/373; 422/159; 422/903; 423/DIG. 20

[58] Field of Search ..... 252/633; 250/506.1, 250/507.1; 423/DIG. 20; 220/371, 372, 373, 256; 422/159, 903

[56] References Cited

U.S. PATENT DOCUMENTS

| | | | |
|---|---|---|---|
| 3,966,175 | 6/1976 | Stock et al. | 259/8 |
| 4,058,479 | 11/1977 | White et al. | 252/628 |
| 4,449,242 | 5/1984 | Sliney, Jr. | 383/103 |
| 4,545,498 | 10/1985 | Schmid | 215/260 |
| 4,632,779 | 12/1986 | Mizuno et al. | 252/629 |
| 4,980,094 | 12/1990 | Critchley et al. | 252/633 |

FOREIGN PATENT DOCUMENTS

| | | | |
|---|---|---|---|
| 2847929 | 5/1980 | Fed. Rep. of Germany | 220/373 |
| 2414849 | 9/1979 | France | 220/373 |

*Primary Examiner*—Brooks H. Hunt
*Assistant Examiner*—Ngoclan T. Mai
*Attorney, Agent, or Firm*—Antonelli, Terry, Stout & Kraus

[57] ABSTRACT

A vessel for solidifying radioactive waste pellets includes a vessel body, an inner lid mounted within the vessel body and fixedly secured to an upper portion of the vessel body, and a device for preventing the pellets from floating fixedly secured one end thereof to the inner lid. The inner lid has an opening formed at a generally central portion thereof, and the pellet float prevention device is extended into the opening of the inner lid to define gaps therebetween allowing the passage of a solidifying material in the state of a liquid or a slurry therethrough but preventing the passage of the radioactive waste pellets therethrough. The pellet prevention device, when receiving a downward urging force, is bent downward to enlarge the gaps therebetween for allowing the radioactive waste pellets to pass therethrough. The pellet float prevention device is returned by a resilient restoring force to its initial position when the downward urging force is released. The pellet float prevention device comprises a plurality of coil springs fixedly secured to the inner lid in a radial manner, and some of the plurality of coil springs extend to an area close to the center of the opening in the inner lid. The coil springs are extended in such a manner that the axis of each of the coil springs is displaced a predetermined angle from the center of the opening in the inner lid.

14 Claims, 5 Drawing Sheets

VESSEL FOR SOLIDIFICATION TREATMENT OF RADIOACTIVE WASTE PELLETS

BACKGROUND OF THE INVENTION

This invention relates to a solidification treatment vessel into which radioactive waste pellets are charged, and then a solidifying material in the state of a liquid or a slurry is poured into the vessel to solidify the radioactive waste pellets. The invention also relates to a method of solidification treatment of such pellets, using the above vessel.

Recently, there has been used a method of treating a radioactive waste in which a concentrated waste liquid, a waste sludge, a used ion exchanger resin or the like is formed into powder by a vertical thin film dryer, and then the powder is formed into pellets of the tablet type or the briquette type by the addition of an appropriate amount of a suitable binder. There has also been used a method in which ash resulting from combustible wastes burnt in an incinerator is suitably sieved, and then is formed into pellets in the same manner as described above. Such pellets are charged into a suitable vessel or container, and then a liquid-state or slurry-state solidifying material of an organic or an inorganic type (e.g. a cement type or a plastic type) is poured into the vessel to uniformly fill the spaces between the pellets, and is solidified in the vessel, thereby forming a stable solid mass.

In the above pouring of the solidifying material, if the specific gravity of the pellets is lower than that of the solidifying material slurry, the pellets tend to float on the surface of the solidifying material slurry at a final stage of the pouring operation. Therefore, without a suitable float prevention means, many pellets float and appear on the surface of the solidifying material.

In one conventional method of preventing such a float phenomenon, after a predetermined amount of pellets are charged into the vessel, an iron frame or the like having a metal net whose mesh is smaller than the size of the pellet is fixed to the upper portion of the vessel, and then the solidifying material slurry is poured into the vessel through the metal net from above this metal net, thereby preventing the floating of the pellets. Then, the vessel is left to stand until the viscosity of the solidifying material increases to such a degree as to restrain the floating of the pellets, and then the iron frame with the metal net is removed from the vessel, and then a required amount of solidifying material is post-filled in the upper space of the vessel.

This conventional method has the following disadvantages:

If the iron frame with the metal net is fixed to the upper portion of the vessel before the pellets are charged into the vessel, a subsequent charging of pellets into the vessel is prevented by the metal net. Therefore, in the above conventional method, the iron frame with the metal net is fixed to the upper portion of the vessel after the pellets are charged into the vessel, and then the solidifying material is poured into the vessel. Thereafter, the iron frame with the metal net is removed for re-use.

However, after the charging of the pellets, the wall of the vessel is stained with dust of the pellets, and the iron frame with the metal net can not be easily attached to the vessel. And besides, a mechanism for the attachment and detachment of the iron frame relative to the vessel is complicated, and an automatic remote control which is desired for preventing the radiation exposure can not be easily achieved.

In addition, when the iron frame with the metal net is to be removed from the vessel after the pouring of the solidifying material, the solidifying material is liable to be scattered over the surroundings, and it is troublesome to handle the thus removed iron frame. To avoid these problems, it can be considered that the iron frame with the metal net is not removed from the vessel even after the pouring of the solidifying material, and is embedded in the solidifying material in the vessel. In this case, also, the iron frame with the metal net must be attached to the upper portion of the vessel after the pellets are charged into the vessel. Therefore, the same problems as described above are also encountered.

In order to charge a Predetermined amount of the pellets into the vessel with preventing the jumping of the pellets out of the vessel and the scattering of the dust, it is preferred that a kind of lid be mounted on the upper portion of the vessel and that the pellets are charged into the vessel via a charge pipe extending through this lid. However, even with this pellet-charging method, it is impossible to charge the pellets, with the iron frame with the metal net (which prevents the floating of the pellets when the solidifying material is poured at a later stage) being beforehand attached to the upper portion of the vessel. Therefore, after the charging of the pellets, the lid is removed from the vessel, and thereafter the iron frame with the metal net must be attached to the upper portion of the vessel. Thus, the same problems as described above are also encountered.

SUMMARY OF THE INVENTION

With the above deficiencies of the prior art in view, it is an object of the present invention to provide a vessel for solidifying radioactive waste pellets which vessel enables the charging of the pellets and the pouring of a solidifying material without the need for attaching and detaching a pellet float-prevention member, and also enables an easy automatic remote control of such charging and pouring.

Another object of the invention is to provide a method of solidifying radioactive waste pellets, using the above vessel.

According to one aspect of the present invention, there is provided a vessel for the solidifying radioactive waste pellets comprising:

a vessel body;

an inner lid mounted within the vessel body and fixedly secured to an upper portion of the vessel body, the inner lid having an opening formed at a generally central portion thereof; and means for preventing the pellets from floating fixedly secured at one end thereof to the inner lid and extending into the opening to define therebetween gaps allowing the passage of a solidifying material in the state of a liquid or a slurry therethrough but preventing the passage of the radioactive waste pellets therethrough, the pellet float prevention means, when receiving a downward urging force, being bent downward to enlarge the gaps for allowing the radioactive waste pellets to pass therethrough, and the pellet float prevention means being returned by a resilient restoring force to its initial positions when the downward urging force is released.

According to another aspect of the invention, there is provided a method of solidifying radioactive waste pellets comprising the steps of:

(a) providing a vessel for solidifying the radioactive waste pellets of the above-explained;

(b) lifting the vessel so as to insert a charge pipe through the opening of the inner lid, so that the pellet float prevention means is bent by the charge pipe;

(c) subsequently charging the radioactive waste pellets into the vessel through the charge pipe;

(d) subsequently descending the vessel so as to remove the charge pipe from the opening, so that the pellet float prevention means is automatically returned to their respective initial positions; and (e) subsequently charging a solidifying material into the vessel while preventing the floating of the charged pellets by the pellet float prevention means, and allowing the solidifying material to solidify, the solidifying material being in the state of a liquid or a slurry and being higher in specific gravity than the pellets.

In the present invention, the pellet float prevention means is bent to enlarge the gaps therebetween so as to charge the pellets into the vessel body through these gaps. After the charging of the pellets, the pellet float prevention means is returned by the resilient restoring force to its initial position, so that the gaps between the pellet float prevention means do not allow the passage of the pellets therethrough. After the pellet float prevention means is returned to its initial position, the solidifying material in the state of a liquid or a slurry can be poured through the above gaps, while preventing the floating of the pellets by the pellet float prevention means. Therefore, the charging of the pellets and the pouring of the solidifying material can be carried out quite easily, as compared with the prior art in which the iron frame with the metal net must be detached and attached before and after the charging of the pellets.

The pellet float prevention means of the bendable, restoring type are provided at the opening of the inner lid, and the pellets are charged by inserting the charge pipe through the opening of the inner lid. Therefore, the scattering of dust and the jumping of the pellets out of the vessel at the time of the charging of the pellets can be prevented. Further, the inner lid can be embedded, together with the pellet float prevention means, in the poured solidifying material, and do not need to be removed, and therefore the solidifying of the pellets can be carried out more easily.

DESCRIPTION OF THE PREFERRED EMBODIMENTS

Figure 1:
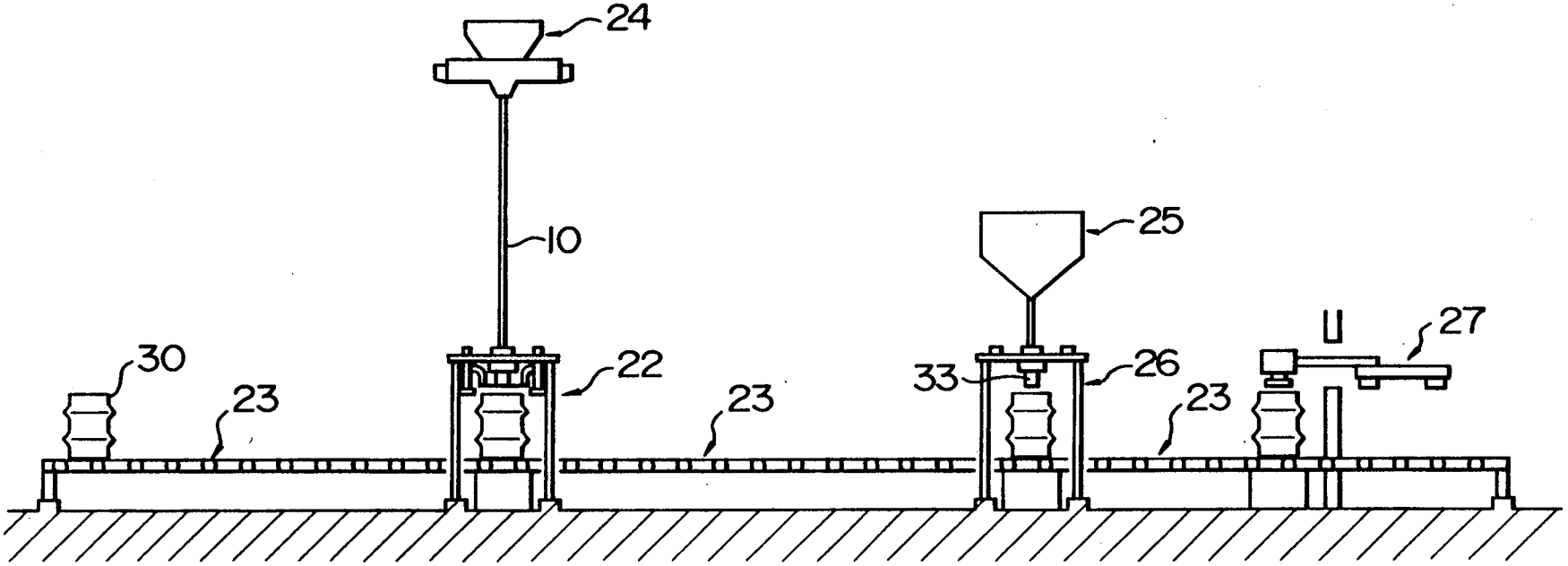
FIG. 1 is a schematic view of a solidifying system for performing a method of solidifying radioactive waste pellets according to the present invention.

A system for solidifying radioactive waste will be described with reference to FIG. 1. The radioactive waste is formed into powder by a vertical thin film dryer (not shown). Then, in a pelletizer 24, the powder is formed into pellets of a predetermined size by the addition of a binder. A solidifying vessel or container 30 is placed on a conveyor device 23, and is conveyed to a pellet charge device 22. In the pellet charge device 22, the vessel 30 is lifted, so that a pellet charge pipe 10 extending downward from the pelletizer 24 is introduced into the vessel 30. Then, a predetermined amount of the pellets are charged into the vessel 30 via the pellet charge pipe 10. Then, the vessel 30 is moved downward, so that the pellet charge pipe 10 is separated or removed from the vessel 30. Then, the vessel 30 is conveyed by the conveyor device 23 to a solidifying material-pouring device 26. In the solidifying material-pouring device 26, a solidifying material in the state of a liquid or a slurry is poured into the vessel 30 from a solidifying material tank 25. Thereafter, the vessel 30 is conveyed to a capping device 27 where a metallic top lid or cap 4 with a packing, as well as a clamping band 5, are attached to the vessel 30 (see FIG. 2). Then, the vessel 30 is transferred to a predetermined storage place.

Figure 2:
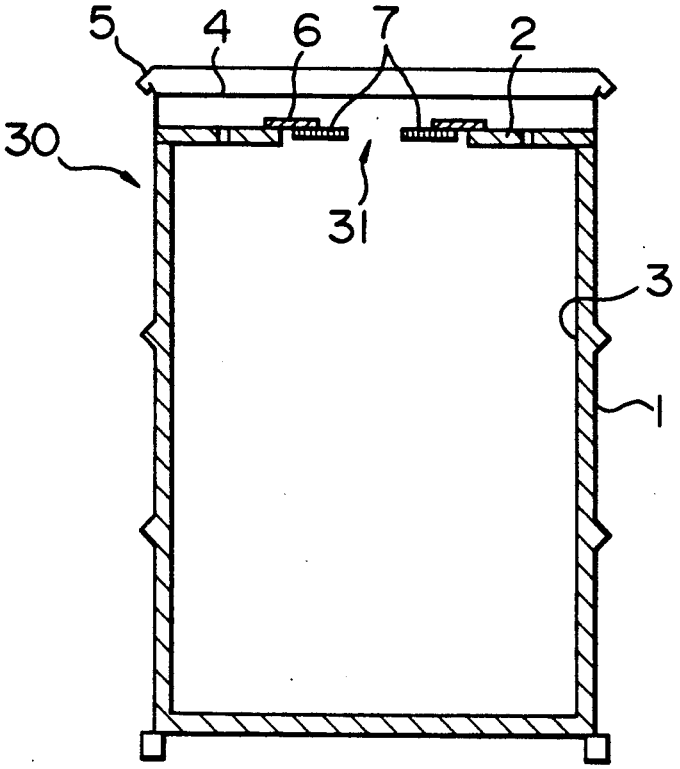
FIG. 2 is a vertical cross-sectional view of a vessel for solidifying radioactive waste pellets provided in accordance with a first embodiment of the invention.
Figure 3:
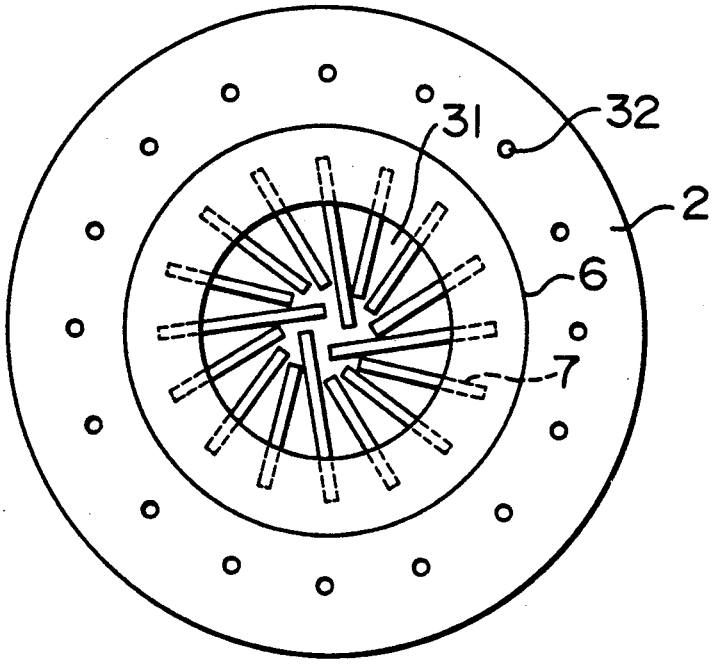
FIG. 3 is a top plan view of an inner lid of the vessel of the first embodiment.

A first embodiment of a radioactive waste pellet solidifying vessel of the invention will now be described with reference to FIGS. 2 to 7. For example, a metal drum having a volume of 200 liters is used as the solidifying vessel. A liner 3 of concrete is formed on an inner surface of a body 1 of the vessel, and a concrete lid 2 constituting an inner lid is bonded to the upper end of the liner 3 by an epoxy resin adhesive or the like, the concrete lid 2 being disposed slightly below the upper end of the vessel body 1. The concrete lid 2 has a central opening 31, and a ring-shaped iron plate 6 is bonded by an epoxy resin adhesive or the like to the inner lid 2 in concentric relation to the central opening 31. A plurality of (16 in this embodiment) coil springs 7 are bonded at their one ends to the lower surface of the ring-shaped iron plate 6, and extend in such a manner that the axis of each of the coil springs 7 is displaced an angle of about 7° from the center of the central opening 31. The coil spring 7 has an outer diameter of 10 mm, and is made of a wire having a diameter of 1.0 mm. The space or gap between any two adjacent coil springs 7 is smaller than the size of one radioactive waste pellet. As shown in FIG. 3, four coil springs 7 are longer than the other coil springs 7 in order to prevent the floating of the pellets at the central portion of the vessel. Air bleed holes 32 are formed through the inner lid 2 so as to prevent the air from being trapped in the vessel body 1 when the solidifying material is poured into the vessel as later described. In FIG. 2, reference numeral 4 denotes the metallic top lid (having a packing) for the vessel 30, and reference numeral 5 denotes the clamping band for securing the top lid 4 to the vessel 30.

Next, a method of charging the radioactive waste pellets into the vessel of the above construction, as well as a method of pouring the solidifying material into the vessel, will now be described. In this example, the volume of one pellet is about 17 ml, and a paste of cement glass (mixture of cement and water-glass) which is about 0.3 gr/cm$^3$ higher in specific gravity than the pellet is used as the solidifying material.

Figure 4:
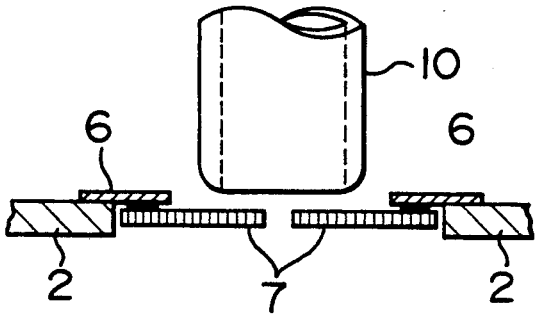
FIGS. 4 to 6 are fragmentary side-elevational views, in which a part is sectioned, of important portions of pellet float prevention means of the first embodiment and a charge pipe, showing conditions during the pellet charging operation.

First, in the pellet charge device 22, the vessel 30 is lifted in such a manner that the pellet charge pipe 10 can be inserted through the central opening 31 of the ring-shaped iron plate 6, as shown in FIG. 4.

Figure 5:
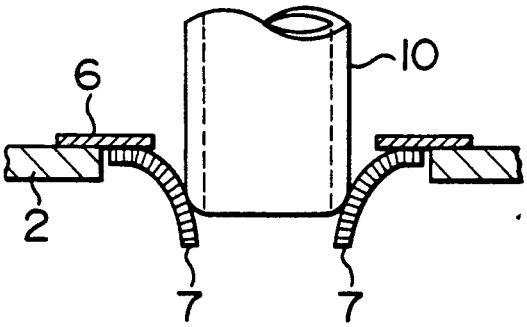
Figure 6:
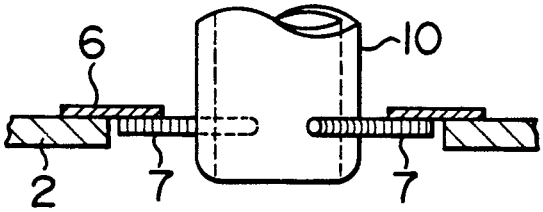
Figure 7:
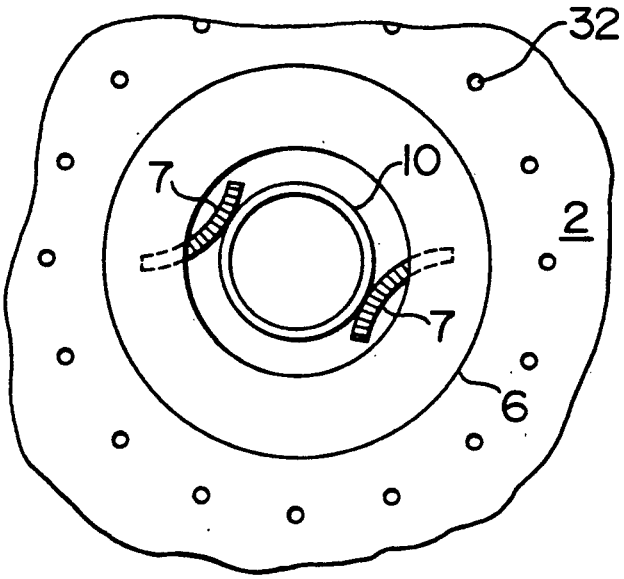
FIG. 7 is a top plan view of the condition shown in FIG. 6.

The outer periphery of the lower end of the charge pipe 10 has been worked to have a curvature radius of several millimeters. When the vessel 30 is further lifted, the coil springs 7 are bent or flexed downward by the lower end of the charge pipe 10, as shown in FIG. 5. When the charge pipe 10 is inserted a certain depth (20 to 50 mm), the coil springs 7 are moved upward by their own resiliency, so that the coil springs 7 are generally horizontally bent in contact with the outer periphery surface of the charge pipe 10, as shown in FIGS. 6 and 7 (in which only two coil springs 7 are shown). Then, a predetermined amount of the pellets are charged into the vessel 30 through the charge pipe 10 (in this case, it is desirable to provide a charge amount-monitoring sensor in the vicinity of the lower end of the charge pipe 10). Then, the vessel 30 is moved downward so as to remove the charge pipe 10 from the central opening 31, so that the coil springs 7 are returned to their respective initial positions shown in FIGS. 3 and 4.

Then, in the solidifying material-pouring device 26, a pouring pipe 33 is disposed just above the opening 31 of the ring-shaped iron plate 6, and the solidifying material slurry is poured from the pouring pipe 33 into the vessel 30 through the opening 31 of the iron plate 6 and the gaps between the coil springs 7. The floating of the pellets caused by the poured solidifying material slurry is restrained by the lower surface of the concrete lid 2, and those pellets tending to float upward at the central opening 31 are prevented by the coil springs 7 from floating. Namely, the strength of the coil springs 7 is so determined as to prevent such floating. In this condition in which the floating of the pellets is prevented, the solidifying material is further poured to such a level that the concrete lid 2, the iron plate 6 and the coil springs 7 can be embedded in the solidifying material. Then, the top lid 4 is attached to the vessel body 1, and is secured thereto by the clamping band 5.

It has been confirmed through experiments that the charging of the pellets and the pouring of the solidifying material have been carried out satisfactorily, while preventing the floating of the pellets.

In the above embodiment, although the coil springs 7 are fixedly mounted on the concrete lid 2 through the ring-shaped iron plate 6, the coil springs 7 may be fixedly mounted directly on the concrete lid 2. If the concrete lid 2 has a weight large enough to overcome the buoyancy, it may not be fixedly secured to the upper end of the concrete liner 3, but may be merely placed on this upper end.

Figure 8:
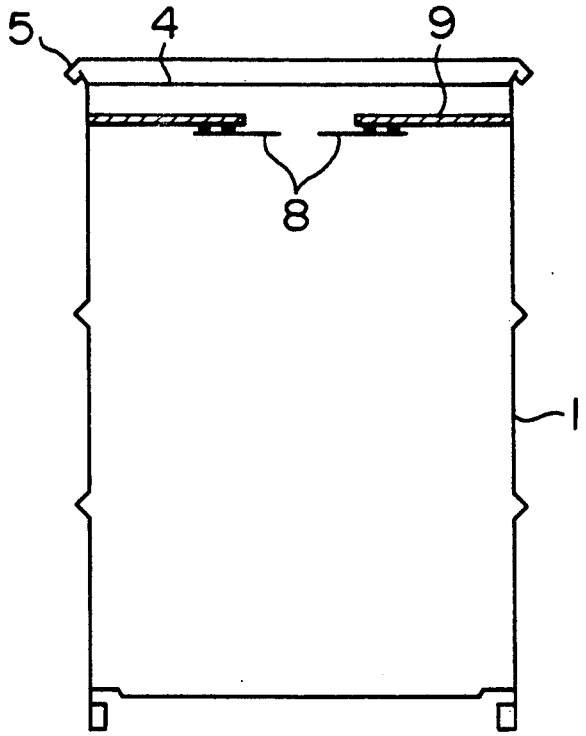
FIG. 8 is a vertical cross-sectional view of a vessel for solidifying radioactive waste pellets provided in accordance with a second embodiment of the invention.
Figure 9:
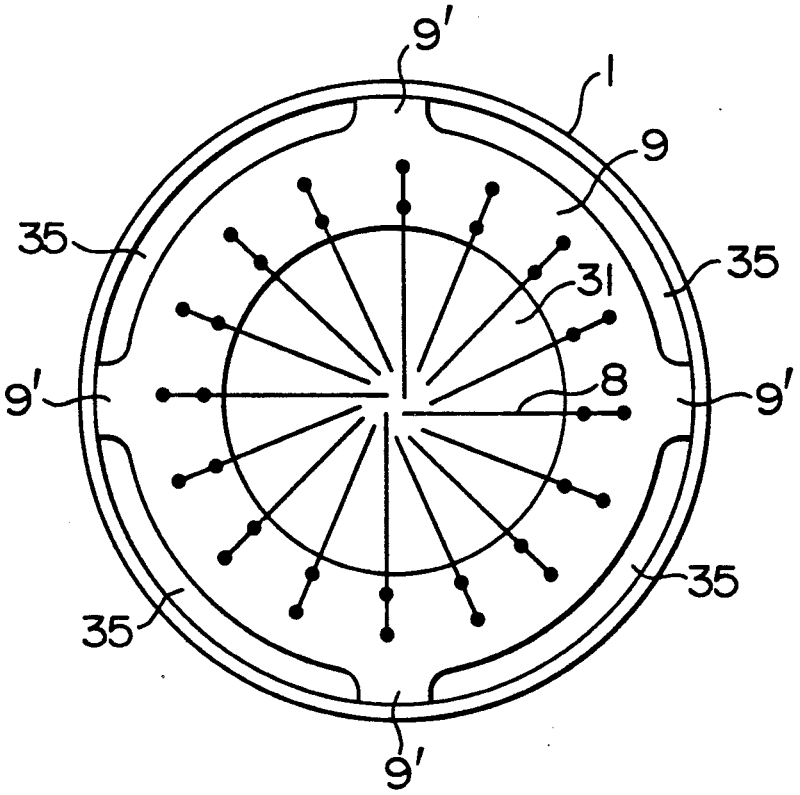
FIG. 9 is a bottom plan view of an inner lid of the vessel of the second embodiment.

Next, a second embodiment of a solidifying vessel of the invention will now be described with reference to FIGS. 8 and 9. A ring-shaped iron plate lid 9 is bonded by welding or an epoxy resin to that portion of an inner peripheral surface of a vessel body 1 disposed slightly below the upper end of the vessel body 1. Two pairs of diametrically-opposite tabs 9' are formed on the outer peripheral edge of the iron plate lid 9, and the tabs 9' are fixedly secured to the inner peripheral surface of the vessel body 1. With this arrangement, arcuate gaps 35 are formed between the inner peripheral surface of the vessel body 1 and the outer periphery of the iron plate lid 9. The gaps 35 perform the same function as that of the air bleed holes 32 in the first embodiment. A plurality of piano wires 8 are bonded at their one ends to the lower surface of the iron plate lid 9 by welding or an epoxy resin, and extend in such a manner that the axis of each of the piano wires 8 is displaced an angle of about 5° from the center of a central opening 31 of the iron plate lid 9. Each of the piano wires 8 has a diameter of about 1.5 mm. In order to prevent the floating of the pellets at the central portion of the vessel body 1, four piano wires 8 are longer than the other piano wires 8, as shown in FIG. 9. The piano wires 8 perform the same function as that of the coil springs 7 in the first embodiment. The pellets, each having a volume of about 9 ml to about 17 ml and being about 0.4 mg/cm$^3$ lower in specific gravity than the solidifying material slurry, were charged into the vessel 30 of this embodiment, and the solidifying material slurry was poured into the vessel 30 of this embodiment. As a result, the charging of the pellets and the pouring of the solidifying material were satisfactorily carried out while preventing the floating of the pellets, as in the first embodiment.

In the above first and second embodiments. In order that the coil springs 7 or the piano wires 8 can have a sufficient strength to prevent the floating of the pellets, the diameter of the coil spring 7 and the diameter of the piano wire 8, as well as the material for the coil spring 7 or the piano wire 8, are determined depending on the buoyance of the pellets. In the above embodiments, although the coil springs 7 or the piano wires 8 are so extended that their axes are displaced from the center of the central opening 31 into which the charge pipe 10 is adapted to be inserted, the coil springs 7 or the piano wires 8 may be directed toward the center of the central opening 31. In this case, however, the coil springs 7 or the piano wires 8 can not easily be moved by their own resiliency from the condition shown in FIG. 5 to the condition shown in FIGS. 6 and 7, and therefore, it is necessary to slightly reduce the amount of charge of the pellets into the vessel 30 in order to ensure that after the charge pipe 10 is removed from the central opening 31, the coil springs 7 or the piano wires 8 can be restored to the condition shown in FIG. 4 without being prevented by the pellets in the vessel 30. Therefore, it is advantageous that the coil springs 7 or the piano wires 8 should be extended in such a manner as to be slightly displaced from the center of the opening 31, as described in the first and second embodiments, because this can increase the amount of charge of the pellets into the vessel.

In the first embodiment, the provision of the concrete liner 3 is not of absolute necessity, and instead of the concrete lid 2, an iron plate lid having a central opening may be used as an inner lid, and be welded or bonded to the inner peripheral surface of the vessel body 1.

Also, the above inner lid, such as the concrete lid 2 and the iron plate lid 9, may be omitted, in which case the proximal ends of the coil springs or the piano wires (whose distal end portions are extended to the central portion of the vessel) are fixedly secured directly to the inner peripheral surface of the vessel body. However, the above embodiments in which the inner lid is provided, and the charge pipe is inserted in the central opening of the inner lid so as to charge the pellets into the vessel, are more advantageous in the prevention of the scattering of the pellet dust at the time of the pellet charging, the prevention of the jumping of the pellets out of the vessel, and the prevention of the floating of the pellets.

The coil springs or the piano wires may be replaced by leaf springs, rubber members, plastics members or the like which have such flexible (bendable) and restoring properties that they can be bent or flexed upon insertion of the charge pipe, and can be restored upon withdrawal of the charge pipe so as to prevent the floating of the pellets thereafter.

Figure 10:
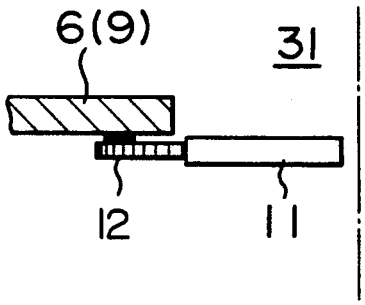
FIGS. 10, 11 and 12 are cross-sectional views of left portions of inner lids of vessels of third, fourth and fifth embodiments, of the invention, respectively.

At the time of the charging of the pellets, the coil spring 7 or the piano wire 8 is mainly bent by the charge pipe 10 at that portion thereof disposed in the vicinity of its proximal end. Therefore, as indicated in a third embodiment of the invention shown in FIG. 10, the coil spring 7 or the piano wire 8 may be replaced by a float prevention member which comprises a resilient element 12 (which corresponds to said that portion of the coil spring 7 or the piano wire 8), such as a coil spring or a piano wire, and a bar 11 of relatively high rigidity extending from the distal end of the resilient element 12.

Figure 11:
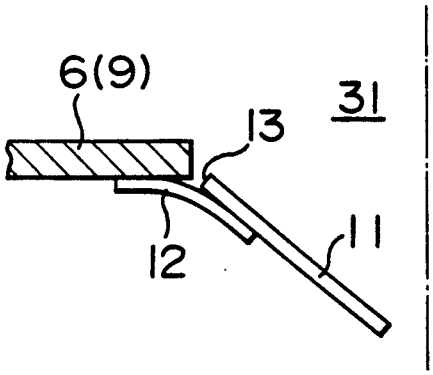

In a fourth embodiment of the invention shown in FIG. 11, the coil spring 7 or the piano wire 8 is replaced by a float prevention member which comprises a bar 11 extending into the central opening 31 of the ring-shaped iron plate 6 or the ring-shaped iron plate lid 9, and a resilient element 12 (e.g. a coil spring, a piano wire, or a leaf spring) interconnecting the bar 11 and the iron plate 6 or the iron plate lid 9. The bar 11 is urged upward by the resilient element 12 to a horizontal position where a proximal end 13 of the bar 11 is abutted against the inner peripheral surface or edge of the central opening 31 of the iron plate 6 or the iron plate lid 9 to limit a further upward movement of the bar 11.

Figure 12:
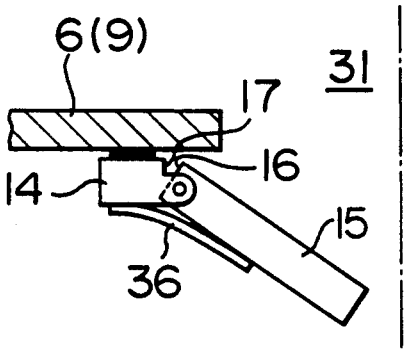

In a fifth embodiment of the invention shown in FIG. 12, the coil spring 7 and the piano wire 8 is replaced by a float prevention member which comprises a base member 14 fixedly secured to the lower surface of the iron plate 6 or the iron plate lid 9 adjacent to the central opening 31, a bar 15 hingedly connected at one end to the base member 14, and a spring member 36 mounted on the hingedly-connected portion. The bar 15 is urged upward by the spring member 36 to a horizontal position where a proximal end 16 of the bar 15 is abutted against a stopper surface 17 of the base member 14 to limit a further upward movement of the bar 15. The float prevention member shown in FIG. 11 or FIG. 12 is used instead of the coil spring 7 of the first embodiment or the piano wire 8 of the second embodiment, and therefore it will be appreciated that a plurality of such float prevention members are provided at the central opening 31 of the iron plate 6 or the iron plate lid 9, as in the first and second embodiments. In the embodiments shown in FIGS. 11 and 12, the bars 11 or 15 are returned to the horizontal positions when the charge pipe 10 is removed from the central opening 31 after the charging of the pellets into the vessel, and thereafter even if the bars 11 or 15 receive the floating force of the pellets from below these bars at the time of pouring the solidifying material slurry, the above-mentioned stopper mechanism serves to hold the bars 11 or 15 in the horizontal positions, thereby positively preventing the floating of the pellets.

Figure 13:
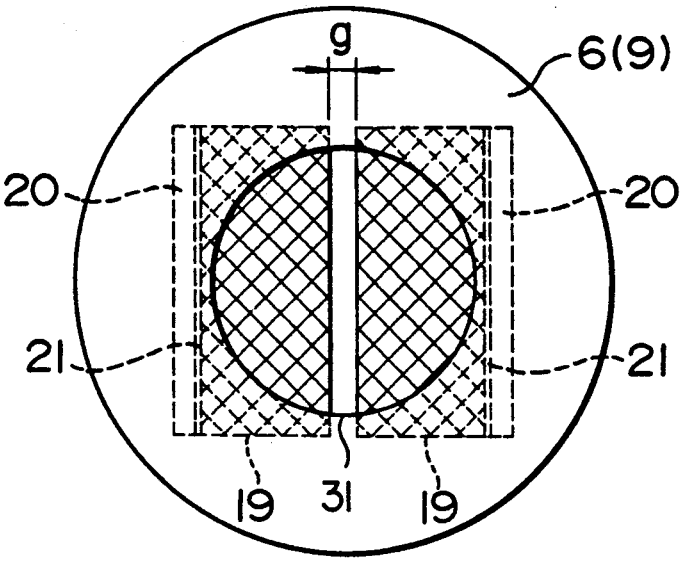
FIG. 13 is a top plan view of an inner lid of a vessel of a sixth embodiment of the invention.

FIG. 13 is a top plan view of a fifth embodiment of the invention, showing an inner lid and its associated parts. Two base members 20 and 20 are fixedly secured to the lower surface of the iron plate 6 or the iron plate lid 9 by welding or an adhesive. Two metal nets 19 and 19 of a rectangular shape are hingedly connected to the two base members 20 and 20, respectively. Each of the metal nets 19 and 19 is urged upward by spring means (which is not shown and is provided at the hinged portion) so as to be angularly moved about an axis 21 of the hinge into a horizontal position where the metal net 19 is abutted against the lower surface of the iron plate 6 or the iron plate lid 9. Therefore, the length of the metal net 19 is slightly greater than the diameter of a central opening 31 of the iron plate 6 or the iron plate lid 9. A gap g between the two metal nets 19 and 19 disposed at their respective horizontal positions, and the mesh of each metal net 19 are smaller than the size of one pellet. When the charge pipe 10 is inserted into the central opening 31 at the time of charging the pellets in a similar manner as described above, the two metal nets 19 and 19 are opened or angularly moved downward away from each other about the respective hinge axes 21 and 21, and therefore the pellets can be charged into the vessel from the charge pipe 10 through this open space between the two metal nets 19 and 19. Then, when the charge pipe 10 is removed from the central opening 31 after the charging of the pellets, the two metal nets 19 and 19 are returned to their respective initial positions. Thereafter, the solidifying material slurry is poured into the vessel through the metal nets 19 and 19 from above these metal nets. The floating of the pellets at the central opening 31 is positively prevented by the two metal nets 19 and 19 stopped by the lower surface of the iron plate 6 or the iron plate lid 9.

What is claimed is:

1. A vessel for solidifying radioactive waste pellets comprising:

a vessel body;

an inner lid mounted within said vessel body and fixedly secured to an upper portion of said vessel body, said inner lid having an opening formed at a generally central portion thereof; and means for preventing the pellets from floating fixedly secured at one end thereof to said inner lid and extending into said opening to define therebetween gaps allowing the passage of a solidifying material in the state of a liquid or a slurry therethrough but preventing the passage of the radioactive waste pellets therethrough, said pellet float prevention means, when receiving a downward urging force, being bent downward to enlarge the gaps for allowing the radioactive waste pellets to pass therethrough, and said pellet float prevention means being returned by a resilient restoring force to its initial position when said downward urging force is released.

2. A vessel according to claim 1, wherein said pellet float prevention means comprises a plurality of coil springs fixedly secured to said inner lid in a radial manner, some of said plurality of coil spring extending to an area close to the center of said opening in said inner lid.

3. A vessel according to claim 1, wherein said pellet float prevention means comprises straight resilient wires fixedly secured to said inner lid in a radial manner, some of said plurality of resilient wires extending to an area close to the center of said opening in said inner lid.

4. A vessel according to claim 2, wherein said plurality of coil springs are extended in such a manner that the axis of each of said coil springs is displaced a predetermined angle from the center of said opening in said inner lid.

5. A vessel according to claim 3, wherein said plurality of straight resilient wires are extended in such a manner that the axis of each of said resilient wires is displaced a predetermined angle from the center of said opening in said inner lid.

6. A vessel according to claim 1, wherein said pellet float prevention means comprises resilient elements fixedly secured to said inner lid, and bar-like elements fixedly secured to said resilient elements and normally urged by a resilient force of said resilient elements to a generally horizontal position, said resilient elements of said pellet float prevention means being arranged in a radial manner, and said bar-like elements having one end which is held against an inner peripheral surface of said opening of said inner lid in said generally horizontal position of said bar-like elements so as to prevent upward movement of said bar-like elements beyond said generally horizontal position.

7. A vessel according to claim 1, wherein said pellet float prevention means comprises base elements fixedly secured to a lower surface of said inner lid, bar-like elements hingedly connected to said base elements, and resilient elements normally urging said bar-like elements to a generally horizontal position, and said bar-like elements having a stop surface which is held against said base elements in said generally horizontal position of said bar-like elements so as to prevent an upward movement of said bar-like elements beyond said generally horizontal position.

8. A vessel according to claim 1, wherein said pellet float prevention means comprises a pair of metal nets hingedly connected to a lower surface of said inner lid, and a pair of resilient elements which respectively urge normally said pair of metal nets to a generally horizontal position.

9. A vessel according to claim 1, wherein said inner lid has a plurality of air bleed holes formed therethrough.

10. A combination comprising:

(a) a vessel for solidifying radioactive waste pellets comprising (i) a vessel body; (ii) an inner lid mounted within said vessel body and fixedly secured to an upper portion of said vessel body, said inner lid having an opening formed at a generally central portion thereof; and (iii) means for preventing the pellets from floating fixedly secured at one end thereof to said inner lid and extending into said opening to define therebetween gaps allowing the passage of a solidifying material in the state of a liquid or a slurry therethrough but preventing the passage of the radioactive waste pellets therethrough, said pellet float prevention means, when receiving a downward urging force, being bent downward to enlarge the gaps for allowing the radioactive waste pellets to pass therethrough, and said pellet float prevention means being returned by a resilient restoring force to its initial position when said downward urging force is released; and (b) a charge pipe for insertion through said opening of said inner lid so as to charge the radioactive waste pellets into said vessel body, a distal end of said charge pipe which is adapted to be inserted through said opening being generally rounded.

11. A combination according to claim 10, wherein said pellet float prevention means comprises a plurality of coil springs fixedly secured to said inner lid in a radial manner, some of said plurality of coil springs extending to an area close to the center of said opening in said inner lid.

12. A combination according to claim 10, wherein said pellet float prevention means comprises straight resilient wires fixedly secured to said inner lid in a radial manner, some of said plurality of resilient wires extending to an area close to the center of said opening in said inner lid.

13. A combination according to claim 11, wherein said plurality of coil springs are extended in such a manner that the axis of each of said coil springs is displaced a predetermined angle from the center of said opening in said inner lid.

14. A combination according to claim 12, wherein said plurality of said straight resilient wires are extended in such a manner that the axis of each of said resilient wires is displaced a predetermined angle from the center of said opening in said inner lid.

* * * * *